United States Patent [19]

Sosnowski

[11] Patent Number: 4,753,181

[45] Date of Patent: Jun. 28, 1988

[54] INCINERATION PROCESS

[76] Inventor: Leon Sosnowski, 62 Wegman St., Auburn, N.Y. 13021

[21] Appl. No.: 62,327

[22] Filed: Jun. 9, 1987

Related U.S. Application Data

[63] Continuation of Ser. No. 632,920, Jul. 20, 1984, abandoned.

[51] Int. Cl.[4] ..... F23G 5/00

[52] U.S. Cl. ..... 110/346; 110/234; 110/238; 110/343; 110/345

[58] Field of Search ..... 110/237, 238, 346, 343, 110/345, 235, 234

[56] References Cited

U.S. PATENT DOCUMENTS

| | | | |
|---|---|---|---|
| 2,873,703 | 2/1959 | Valentine et al. | 110/108 |
| 3,719,583 | 3/1973 | Ustick . | |
| 3,722,433 | 3/1973 | Kramer | 110/238 |
| 3,736,886 | 6/1973 | Menigat . | |
| 3,749,029 | 7/1973 | Bakker et al. . | |
| 3,780,674 | 12/1973 | Liu . | |
| 3,903,813 | 9/1975 | Pan . | |
| 4,253,408 | 3/1981 | Kramer | 110/343 X |
| 4,417,529 | 11/1983 | Fujimoto et al. . | |
| 4,444,127 | 4/1984 | Spronz | 110/235 |
| 4,475,466 | 10/1984 | Gravely | 110/238 |

*Primary Examiner*—Edward G. Favors

*Attorney, Agent, or Firm*—John J. Byrne; Bradford E. Kile; Kevin M. O'Brien

[57] ABSTRACT

A coincineration process whereby sewage sludge or other toxic liquid chemical waste is incinerated with a supplemental fuel such as municipal refuse, coal, sawdust, tire chips and the like involves introducing the sewage sludge into the incineration zone by means of a pressure spray nozzle or a spinning cone or disc atomizer. In the form of ultrafine solids, liquid or gas, a supplemental fuel may be introduced with the sewage sludge. Supplemental fuel may also be introduced into the incinerator by conventional means. Addition of tire chips in the feed provides in a higher incineration zone temperature and significantly reduces dioxin compounds present in the incineration zone off gas. Also, to reduce the scaling and fouling of the boiler tubes and incinerator, to increase the density and pumpability of the sewage sludge, and to eliminate metal salt deposits from the incinerator, the boiler feedwater and the sewage sludge are each contacted with an electromagnetic field device prior to heating.

43 Claims, 8 Drawing Sheets

INCINERATION PROCESS

This application is a continuation of application Ser. No. 632,920, filed July 20, 1984 now abandoned.

BACKGROUND OF THE INVENTION

This invention relates to an improved coincineration process. More particularly, this invention relates to a coincineration process whereby sewage sludge or toxic liquid chemical waste is removed and combined with a supplemental fuel from the environment and incinerated to produce steam for heating and/or the production of electrical power.

In recent years, a large amount of research and investment has been directed to the development of alternative and economically feasible fuel substitutes for petroleum based fuels due to diminishing fuel reserves and rising costs of heating and generating electricity by conventional means. In this connection, among the more important avenues of research are those which have concentrated upon the incineration of various waste materials such as municipal refuse and sewage sludge as well as other materials having combustible potential or calorific value.

In addition to the investment in the development of alternative fuel sources, a substantial expenditure of effort has also been made to find acceptable substitutes for landfill programs to dispose of sewage sludge and liquid toxic chemical waste. Among the problems frequently associated with landfill programs at the present time are: landfills are not sufficiently sanitary, resulting in considerable leaching which interferes with water supply systems; landfills have become exceedingly costly due to the increased transportation costs necessary to bring waste to the landfill and due to the increased charges for land requiring strict environmental controls; and a generally negative public view with which expansion of existing landfills or establishment of new landfills is often viewed.

In view of the above, there is at the present time a significant need for a system capable of efficiently burning sewage sludge or liquid toxic chemical waste along with solid municipal refuse or other supplemental fuel such as coal, oil, gas and the like. Such a system would not only advantageously use the energy content present in the waste products, but also efficiently dispose of the waste products, thereby reducing landfill and other disposal problems associated with improving the environment.

Prior systems which have attempted to coincinerate sewage sludge and supplemental fuel have suffered from a variety of limitations. In this connection, many coincineration systems have mixed both liquid waste and solid municipal waste together, for example in the same storage pit, prior to introduction of the combined feed to an incinerator by a bulk injection method. Coincineration processes using a bulk injection method of this type have frequently been unsuccessful, however, because the overall moisture content of the combined feed frequently exceeded an acceptable moisture level. When steam generation is desired, the moisture content of the overall feed to the incinerator must generally be maintained below about 30 weight % and, more preferably, below about 27 weight %. Operation of an incineration process at a moisture content of the feed above about 27 weight % generally results in inefficient heat utilization due to the relatively slow burning of this combustible material. In such prior art systems wherein the liquid and solid waste were combined during storage, if the moisture content of the refuse feed exceeded acceptable limits additional fuel such as coal, oil or gas was required to lower the overall fuel/moisture ratio, thereby reducing the amount of waste in both solid and liquid form which could be incinerated for a given amount of fuel.

As stated above, coincineration systems which mixed the liquid and solid waste together prior to incineration frequently encountered instances where an additional fuel such as coal, wood or gas was required to reduce the overall moisture level of the feed. In addition, the decreased rate of feed of the municipal waste to the incinerator resulted in an accumulation of the waste and a corresponding increase in the offensive odor and appearance associated with the incineration site. This offensive condition has been particularly acute with respect to odors attributable to sewage sludge, which commonly runs between 92 and 98% water, in instances where the incoming sewage sludge was stored for relatively long periods of time apart from the solid waste in an effort to reduce the moisture content of the solid refuse to the incinerator.

Another signficant problem associated with heretofore known coincineration processes has been the production of excessive amounts of toxic dioxin compounds in the incinerator off gases. Dioxin compounds, such as 2, 3, 7, 8-tetrachloro dibenzo-p-dioxin ($C_{12}H_4O_2Cl_4$), are toxic in a parts per billion range and, therefore, must be eliminated from incinerator stack gases.

Dioxin compounds are produced in significant quantities from the incineration of plastics, rubbers and the like, and may be eliminated by thermal degradation at temperatures of between 2000° F. and 2300° F. However, the combustion temperature of most coincineration systems is between 1500° F. and 1800° F. which is insufficient to thermally degrade these compounds. The problems associated with the presence of dioxin compounds in incinerator off gases has been particularly acute in systems using the above described bulk injection method, as incomplete incineration of plastic and rubber materials tended to increase the quantity of toxic compounds produced. Also, prior attempts to raise the incinerator temperature such as by adding high energy content refuse materials, such as tire chips, resulted in an unacceptable level of smoke and particulates released to the atmosphere.

Still a further problem frequently encountered by coincineration systems of the prior art involved the deposit of noncombustible materials contained in the sewage sludge in the lower sections of the incinerator. These noncombustible materials, comprising metal salts such as iron and calcuim oxides, tended to accumulate near the walls and grate in the lower section of the incinerator and restrict air flow through the incinerator, thus requiring periodical cleaning. The metal salts in the sewage sludge also adversely affected the consistency and burning character of the sewage sludge and the pumpability of the sludge. Heretofore, no effective method has been developed to eliminate or substantially reduce metal salts in the sewage sludge prior to introduction of the sludge to the incinerator.

While such systems, as noted above, have achieved at least a degree of industry recognition and utilization, room for significant improvement remains.

In this regard, prior art systems have been severely limited as to the quantity of municipal waste which may be introduced into the incinerator by the relatively high water content of the sewage sludge and by the method of introduction of the sewage sludge to the incinerator whereby the sewage sludge is combined with the supplemental fuel in a bulk injection procedure. This limitation on the quantity of municipal waste fuel to the incinerator has resulted in an increased dependency on additional fuel sources such as coal, oil and gas, a decreased amount of waste material which could be incinerated, and increased odor and visual incongruity associated with solid and liquid waste disposal. Moreover, the relatively low incinerator temperature of the prior art systems has not been sufficient to reduce or eliminate toxic dioxin compounds which are formed as a result of the coincineration process, and no acceptable solution has heretofore been developed. Still further, deposit of incombustible material in the lower section of the incinerator has resulted in an increased need for cleaning operations and a restriction in air flow through the incinerator.

The problems suggested in the proceeding are not intended to be exhaustive, but rather are among many which may tend to reduce the effectiveness of prior coincineration processes. Other noteworthy problems may also exist; however, those presented above should be sufficient to demonstrate that coincineration processes appearing in the prior art have not been altogether satisfactory.

OBJECTS OF THE INVENTION

It is, therefore, a general object of the invention to provide a coincineration process which will obviate or minimize problems of the type previously described.

It is a particular object of the invention to provide a novel coincineration process for the elimination of sewage sludge and toxic liquid chemical waste.

It is another object of the invention to provide a novel process for producing steam and/or electricity by coincinerating sewage sludge and a supplemental fuel in an efficient manner.

It is yet another object of the present invention to provide a novel process for the coincineration of combustible fuel under conditions which reduce or eliminate the production of dioxin compounds.

It is still another object of the invention to provide a novel coincineration process which reduces or eliminates the release of substantially all of the acid compounds and particulate material produced by the process into the atmosphere.

It is a further object of the present invention to provide a novel coincineration process operable to eliminate metal salts from the sludge and to increase sludge concentration and consistency characteristics.

It is still a further object of the present invention to provide a novel coincineration process whereby a mixture of sewage sludge and supplemental fuel is pretreated to the mixture to improve the combustion characteristics of the mixture.

SUMMARY OF THE INVENTION

One preferred embodiment of the invention which is intended to accomplish at least some of the foregoing objects comprises a process for coincinerating sewage sludge or toxic liquid chemical waste and a supplemental fuel whereby the supplemental fuel is introduced into an incineration zone operating at incineration conditions to produce a flame front intermediate the vertical length of the incineration zone. The sewage sludge or toxic liquid chemical waste is dispersed downwardly over the flame front in the incineration zone in small droplets to evaporate the water and to burn combustible material present in the droplets and to produce gaseous products and ash. The hot incineration off gases are then recovered from the incineration zone and, if observed, passed to an energy recovery zone to produce steam for heating and/or electrical powers.

In another embodiment, the present invention comprises a process for coincinerating sewage sludge or toxic liquid chemical waste and a supplemental fuel whereby both the sewage sludge or toxic liquid chemical waste and the supplemental fuel are dispersed in relatively small droplets or solid particles over the flame front in the incineration zone to produce hot incineration gases.

In yet another embodiment, the present invention comprises a process for efficiently eliminating dioxin products of coincineration whereby the fuel to the incineration zone comprises at least 15% by weight tire chips and whereby the hot incineration off gases are passed directly to an afterburner zone wherein the dioxin compounds present in the gases are either thermally or catalytically decomposed. The heat present in the off gases from the afterburner zone is then recovered by indirect heat exchange, and the acidic gas and particulate matter is removed from the off gases by a pollution control unit.

In a further embodiment, the sewage sludge for liquid toxic chemical waste is pre-treated before introduction to the incineration zone by the application of an electromagnetic field device which removes noncombustible materials such as metal salts from the sludge, concentrates the combustible material in the sludge and improves pumping, atomization and incineration characteristics. The electromagnetic field device may also be used in the process whereby both the sewage sludge or toxic liquid chemical waste and supplemental fuel are contacted with the device prior to dispersal above the flame front in the incineration zone in relatively small droplets or particles.

In still a further embodiment, the present invention comprises an incineration process whereby feedwater to a boiler is pre-treated with an electromagnetic field device to decrease dissolved solids present therein. By this process, fouling or scaling of boiler tube walls is significantly reduced.

BRIEF DESCRIPTION OF THE DRAWINGS

Other objects and advantages of the present invention will become apparent from the following detailed description of preferred embodiments taken in conjunction with the accompanying drawings wherein.

DETAILED DESCRIPTION OF THE INVENTION

The subject invention comprises an advantageous process for eliminating sewage sludge and toxic liquid chemical waste while producing steam for heating and/or the production of electrical power, particularly by burning municipal refuse without substantially contaminating the atmosphere. Initially, it must be pointed out that this system is contemplated as being used in a municipal town or village. It is recommended that such municipality implement a source sizing system for collecting the household trash so it can be collected in a compactor type truck. This will remove large items, such as stoves, refrigerators, so that they need not be sorted. The compactor trucks can then go directly to the incineration plant and unload the refuse directly into a storage hopper without the necessity of sorting and shredding the refuse. By coincinerating liquid and solid waste in the manner described herein, it is expected that landfill volumes can be reduced by up to 90%.

Before discussing the various methods of carrying out the present invention, it will be realized that, although the essential components have been shown, for the sake of clarity, certain conventional pumps, temperature sensors, water supply inlets, etc. well known to those skilled in the art have been eliminated from the drawings in some instances. Also, it will be understood that the term sewage sludge as used herein also refers to toxic liquid chemical wastes in general.

Figure 1:
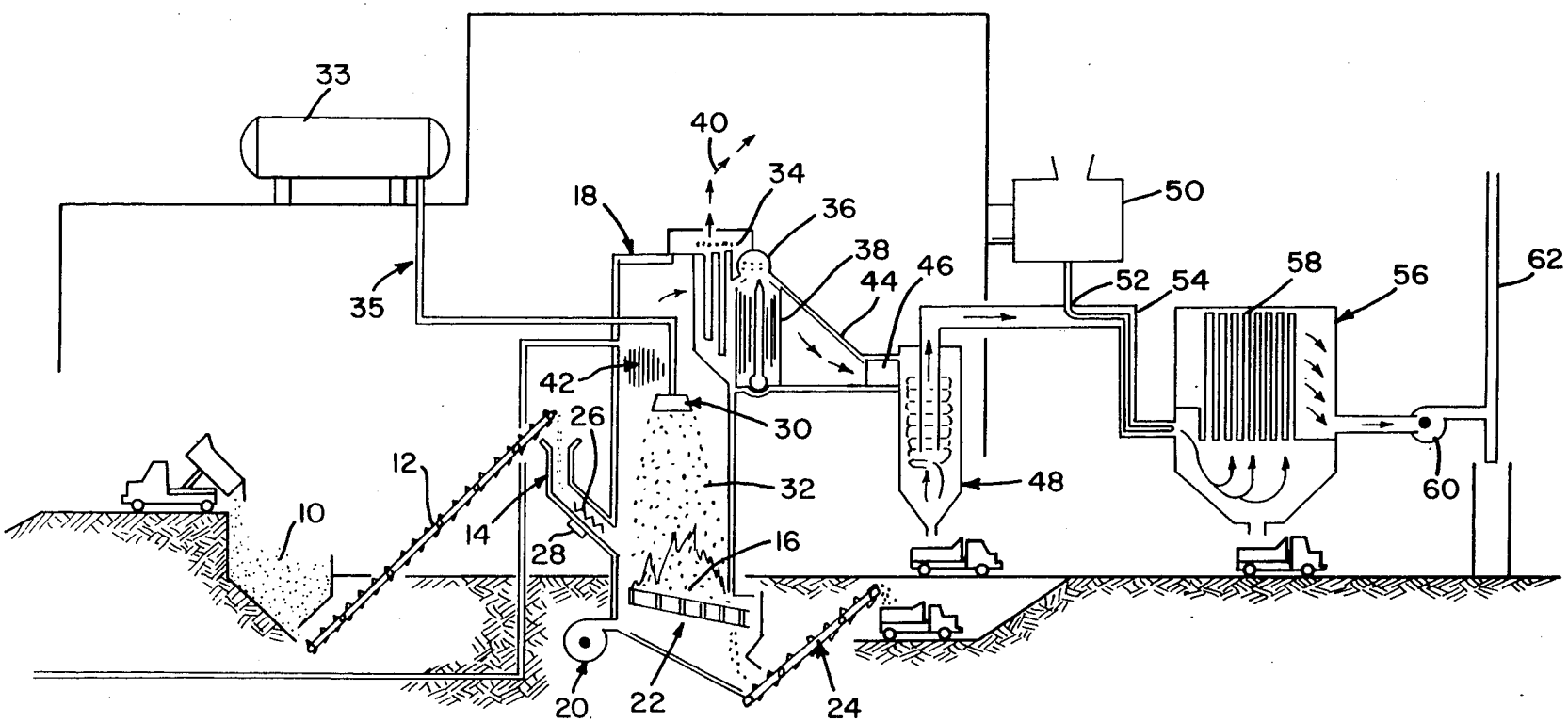
FIG. 1 is a schematic view of one preferred embodiment of the present invention wherein supplemental fuel is introduced at a point intermediate a vertical length of an incineration zone and sewage sludge or toxic liquid chemical waste is dispersed over a flame front by a spinning cone atomizer

Turning now to the drawings, wherein like numerals indicate like parts, a process for eliminating sewage sludge and/or toxic liquid chemical waste and municipal refuse is illustrated in FIG. 1. Trucks loaded with trash, dump the refuse in the refuse storage hopper 10. It is preferred that the refuse is mixed at this point with at least 15% by weight of the total feed to the incinerator of shredded tire chips to increase the burning capacity thereof. Also, although the mixture is primarily solid combustible material, the mixture which is feed to the incinerator through feed hopper 14 may comprise up to 12% or more moisture by weight.

Control of the amount of moisture present in the combustible fuel to the incinerator is significant since the overall moisture control in the feed should be maintained at below 30% by weight and preferably below 27% by weight if steam generation is desired in order to avoid inefficient heat utilization and slow burning. One of the advantages of the present invention is, therefore, that the sewage sludge, which is commonly between 2% and 8% solids, is stored and may be introduced separately from the solid refuse. By the present invention, the need for additional fuel such as coal, oil and the like is frequently avoided. In instances wherein the solid refuse is sufficiently moist to result in an overall fuel moisture content exceeding 27% if the sewage sludge were introduced at a normal rate, the amount of sewage sludge introduced to the incinerator is reduced until the overall moisture content is below 27%. The sludge rate may be maintained at a relatively low rate until the solid refuse is replaced by a drier supply. Conversly, there may be instances when the solid refuse fuel is unusually dry, and relatively large amounts of sewage sludge can be incinerated.

By the present invention, the amount of sewage sludge fed to the incinerator can be controlled in accordance with the moisture content of the solid refuse, which is commonly about 12% but which can vary widely, thus substantially reducing the need for additional fuels. Also, since either the solid or the liquid waste or both will generally be fed to the incinerator on a continuous basis, problems of odor and appearance associated with an accumulation of municipal refuse is largely reduced.

The solid refuse mixture in storage hopper 10 is conveyed by conveyor belt 12 into the double-walled feed hopper 14 wherein it is funneled onto grate 16 in incinerator 18 and burned at temperatures of up to about 2300° F. As mentioned previously, incinerators commonly operate at between 1500° F. and 1800° F. However, by the addition of at least 15% by weight of tire chips, the process of the present invention allows elevated incineration temperatures which significantly reduces the quantity of harmful pollutants such as dioxins from the incinerator off gas.

Underneath the grate 16 is a fan 20 which forces air and/or oxygen into the lower part of the grate, thus ensuring complete combustion of the combustible materials in the trash. As a general rule, about 7.5 pounds of air is the theoretical amount required to release 10,000 BTU from sludge. To ensure complete combustion, however, it is preferred to add from 5% to 150% excess air of that required in the overall incineration process. The grate 16 may be a movable grate (moved by a motor or other means not shown) so that the ashes can be released into the ash pit 22 where they are cooled and conveyed by conveyor 24 into a dump truck, where the ashes with such materials as iron compounds, glass and aluminum are removed and disposed in a suitable land filing operation, and/or used for water drainage fill or as building material or storage in landfill for later use as a salable by-product.

With respect to the feed hopper 14, this is water-cooled to by-pass water between the walls of the double-walled construction to prevent premature melting of materials, such as plastics, etc., which may otherwise melt and clog up the throat of the hopper feeding device. This melting of plastics produces a so-called "bridging" or clogging effect. To further minimize the possibility of such a clogging operation, a special screw drive 26 or auger may be used to force the material down the throat of the hopper 14. This auger is preferably located at the lower portion of the hopper feed 14, where clogging is more apt to occur, although it can be located at the top thereof. Of course, more than one refuse storage hopper or feed hopper system may be employed.

The auger 26 is a screw conveyor which propels the trash down the hopper and is also preferably water-cooled to prevent premature heating of the materials. This auger is of a conventional structure usually having a central shaft containing spiral blades radiating from the center of the shaft so as to propel objects in this case in a downward direction towards entrance into the furnace as the auger is rotated.

In certain cases, wire and other components may get caught up in the auger device and, therefore, an access door 28 may be supplied, which permits an operator to unclog the hopper chute periodically. Of course, one or more access doors may be used. This door may be a sliding door or a hinged door. At any rate, the existence of more than one feed hopper or refuse storage hopper will insure continuous operation of the furnace during the periods when one of the chutes may be clogged up.

Referring now to the upper section of incinerator 18, a sewage sludge atomizer is shown at 30 dispersing droplets of sewage sludge 32 into the combustion zone of incinerator 18. Although reference has been made to sewage sludge in this process, it is understood that droplets 32 could be other known forms of toxic liquid chemical waste.

In any case, sewage sludge from storage tank 33 passes through conduit 35 and into atomizer 30 for dispersion into incinerator 18. In the incinerator, the water contained in the sewage sludge droplets evaporates and the combustible material is burned to produce recoverable energy in the form of hot incineration off gases.

The quantity of sewage sludge that can be burned with the refuse depends upon whether sufficient heat recovery is desired in order to generate steam or power. If no recovery of energy is contemplated, but only the elimination of municipal refuse and sludge, then the sludge may comprise up to 50 weight percent of the fuel to the incineration zone. It is to be understood that this figure applies to average properties of sludge and refuse and that deviation from these average conditions will be reflected in the mix ratio. That is, municipal solid waste derived from residential and commercial refuse typically contains an energy content of approximately 5,000 BTU per pound, taking into account the moisture which may be up to 30% by weight of the refuse and inerts. Also, the heating value of sewage sludge from a storage tank such as has been described with reference to FIG. 1 will typically be approximately 1,500 BTU per pound.

If other combustible fuels are added to the incineration zone with the municipal refuse and sewage sludge, then the weight percent of the sewage sludge in the overall fuel mixture may be adjusted in accordance with the heating value of the added fuel. Table 1 presents examples of fuels which may be used in process of the present invention with the typical heating value of these fuels.

TABLE 1

| Fuel | Heating Value |
|---|---|
| Wood | 7,000–8,000 BTU per pound |

TABLE 1-continued

| Fuel | Heating Value |
|---|---|
| Coal | 12,000–14,000 BTU per pound |
| Tire Chips | 12,500 BTU per pound |
| Oil | 20,000–22,000 BTU per pound |
| Natural gas | 22,000–23,000 BTU per pound |

Thus it is readily apparent from Table 1 that if tire chips are added to the supplemental fuel mixture, then an increased amount of sewage sludge may be introduced to the incinerator.

In the embodiment of the present invention presented in FIG. 1, the hot incineration off gases are used to generate steam and/or electricity. Accordingly, the sewage sludge present in the combustible fuel to the incineration zone is significantly less than when the incineration zone is operated for the primary purpose of removing liquid waste from the environment. When it is desired to generate steam from the incineration zone off gases, the amount of sewage sludge should generally be no more than 15% by weight of the total combustible fuel to the incineration zone. The optimum figure will depend on the properties of the particular fuel used, but it has been found that for a typical municipal refuse and sewage sludge feed, an optimum mix will be 93% municipal refuse and 7% liquid sludge.

It is preferred that tire chips are added to the incineration zone to increase the energy available for sludge combustion and energy recovery. For example, if at least 15% weight tire chips are present in the overall feed, than up to 15% weight sewage sludge may be introduced to the incinerator while maintaining an acceptable steam production level As shown in FIG. 1, the heat produced from the combustion of the fuel heats up the super heater, drum and boiler tube assembly designated 34, 36, and 38 respectively and produces steam through steam exit 40 which is used for heating purposes and/or for the purpose of generating electricity. Refuse burning incinerator 18 has a water-cooled or double-walled construction in which water is circulated through the double wall construction for cooling and heat transfer. The inside of the incinerator is preferably lined with a refractory material such as refractory bricks 42 partially shown in FIG. 1. The double wall construction of incinerator 18 contains water circulating therethrough and the preheated water supplied to the superheater or steam generating pipes serves the dual purpose of cooling the walls of the incinerator and at the same time generating steam to be passed through steam exit 40.

The exhaust gas from the steam generation zone passes through exhaust flue 44 and into economizer 46. The economizer is water-cooled and reduces the temperature of the off gases to between about 350° and 550° F., depending upon the initial temperature of the gas. The construction of such economizers is well known in the art and such a device is known to cool the gases and precipitate or generally eliminate a majority of the soot or ash particles. Particles suspended in the off gas are further removed by means of cylone separator 48.

The cooled gases from cyclone separator 46, which contain acidic pollutants such as $SO_2$, $SO_3$, and HCl are passed through a further pollution control system prior to being released to the atmosphere. As shown in FIG. 1, a preferred means of removing pollutants from the off gases is by means of an alkaline contactor where an intimate contacting of an alkaline powder or slurry/- spray with the gases is conducted. The alkaline material which is stored in vessel 50 is contacted with the off gases at injection point 52 and passes with the off gases through the alkaline contactor section 54. Alkaline dust such as soda ash, trona, nahcolite, lime, etc. or slurried materials such as a lime/limestone, soda ash, trona, nahcolite, etc. react with the acid gases to produce inert innocuous salts which can be readily separated from the gas stream. The alkaline material introduced in the form of a dust or spray also acts as a collector so that impingement and inpaction eliminates particulates from the off gas stream. In addition, alkaline material introduced in the form of a wet mist further cools the gas stream.

The neutralized off gases pass from the alkaline contactor to a bag house where the dry powder and particulates are collected. After passing the off gas through filter bags 58 in the baghouse, the gas is directed through draft fan 60 to stack 62 for release to the atmosphere. By means of a pollution control system described above including an alkaline contactor and a baghouse, up to 99% of the particulatic present in the incinerator off gases are removed even if substantial quantities of tire chips are included in the feed to the incinerator.

It should be noted that other pollution control arrangements may be used in the present invention. For example, a wet scrubbing system based on lime/limestone, sodium carbonate, magnesium oxide, double alkali, or sodium sulfite may be used. The wet scrubbing systems, however, have a problem with equipment and maintenance. Usually thickeners, centrifuges, vacuum filters, and mixers are required. In addition, slurry pumping requirements are significant and wet scrubbing systems are subject to scaling and require more maintenance and instrumentation on wet scrubbing systems can be complex.

In contrast, the dry scrubbing systems such as that described above have a number of advantages over wet systems. For example, the waste from the dry system can be handled by conventional fly-ash handling systems, thereby eliminating sludge handling. Equipment needed for wet system preparation and recycle is largely eliminated, while slurry pumping requirements are much lower. There is no scaling in the dry systems and instrumentation and control is considerably less complex. Finally, dry systems are less capital intensive, are less subject to corrosion problems, and are not plagued by $SO_3$ emissions which can be generated in wet scrubber systems.

Figure 2:
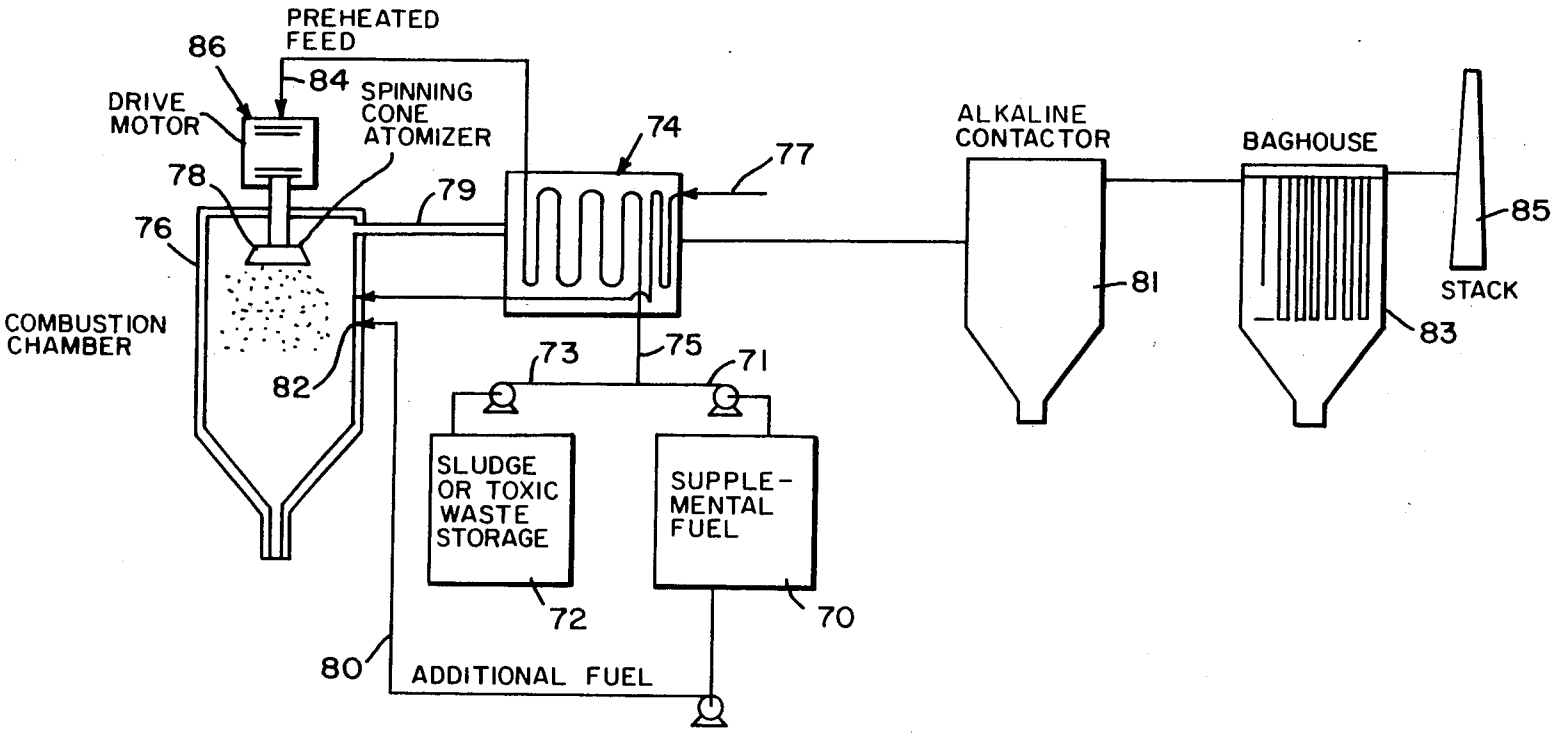
FIG. 2 is a schematic view wherein sewage sludge or toxic liquid chemical waste and supplemental fuel are dispersed in combination over the flame front in the incineration zone by a spinning cone atomizer and additional fuel is introduced to the incineration zone by conventional means.

An alternate embodiment of the present invention is illustrated in FIG. 2 wherein supplementary combustible fuel is combined with sewage sludge and passed in admixture to the incinerator 76 by means of a spinning cone 78 atomizer. As shown in this figure, supplementary fuel in conduit 71 from storage vessel 70 and sewage sludge in conduit 73 from storage vessel 72 are combined in conduit 75 and passed to a feed pre-heat zone 74 prior to introduction into incineration zone 76. Combustion air in conduit 77 is also passed to preheat zone 74, where the combustion air and the sewage sludge and supplemental fuel mixture are heated by indirect contact with incinerator off gases passed to the pre-heat zone 74 through conduit 79. The cooled off gases may undergo further heat exchange before being contacted with a pollution control unit including alkaline contactor 81, baghouse 83 and stack 85 as described with reference to FIG. 1, or another suitable pollution control unit, prior to release to the atmosphere.

The combined sludge and supplemental fuel stream is introduced to the incineration zone 76 by means of spinning cone atomizer 78 and dispersed into the incinerator in small droplets or particles. In this embodiment, additional fuel may also be passed by means of conduit 80 into incinerator 76 at a point below that at which the combustible fuel is dispersed by atomizer 78.

Although FIG. 2 shows a supplementary fuel introduced into the incinerator by means of atomizer 78 which is the same as the additional fuel introduced by means of conduit 80 at point 82, it is not essential that the combustible fuel introduced at these points be the same. For example, ultrafine coal may be mixed with the sewage sludge in conduit 75, and municipal refuse including tire chips may be added to the incinerator through conduit 80.

In any case, the supplemental fuel dispersed by atomizer 78 should be a liquid such as oil or a gas such as natural gas or an ultrafine solid such as pulverized coal or sawdust. There is no such requirement on the additional fuel introduced at point 82, however, and this fuel may be any of the types generally described above, including municipal waste, tire chips, wood, coal, etc.

As shown in FIGS. 1 and 2, the liquid sludge may be atomized either alone or in combination with a supplemental fuel such as ultrafine solids, liquid or gas. If the sludge is atomized with a supplemental fuel, the sludge and supplemental fuel may be carried by separate conduits or mixed and dispersed by way of a single conduit 84 to an atomizer such as spinning cone atomizer 78 which is driven by drive motor 86. Mixing the sewage sludge with a supplemental fuel such as ultrafine coal will be advantageous at times when a relatively high flow rate of sludge is desired, such as when liquid waste accumulation is a concern, or when the solid feed to the incinerator is sufficiently moist to allow only a relatively small amount of sludge to be fed to the incinerator under ordinary conditions. Addition of 10%–25% ultrafine coal or, for example, 1 quart of coal per gallon of sewage sludge raises the energy content of the incinerator and allows the introduction of more sewage sludge to the incinerator than would otherwise be acceptable.

Figure 3:
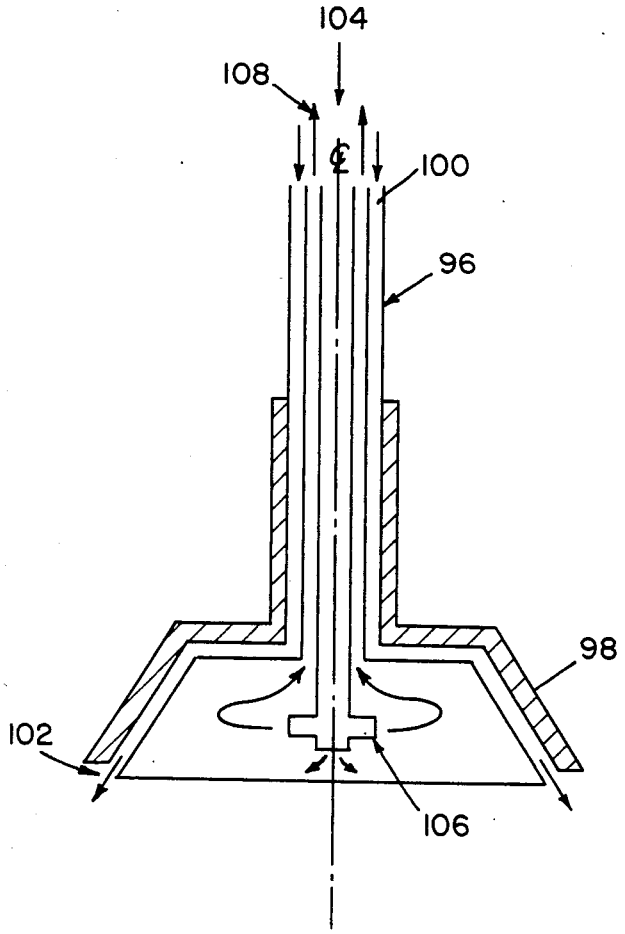
FIG. 3 is a schematic cross-sectional side view of a spinning cone atomizer such as may be used as a dispensing means in the present invention.

As shown in greater detail in FIG. 3, a spinning cone atomizer such as would be used in the present invention contains a concentric set of flow pipes indicated generally at 96. The flow pipes 96 are attached at one end to a conical distributor 98 which is water cooled and protected by refractory material from the heat of the incinerator. The refractory material covering the cone portion of the atomizer may be made of a refractory material well known to those in the art, such as silicon carbide.

Sewage sludge and supplemental fuel enter the spinning cone atomizer through annular conduit 100 and flow through the length of the cone, exiting at point 102. The sludge in the fuel mixture is atomized both through a pressure drop and by a centrifugal action, as the opening at point 102 is relatively small and the entire spinning cone atomizer is rotating such as through the action of a drive motor shown at 86 in FIG. 2. Alternatively, rotation of the atomizer can be affected by placement of a fluid deflection plate at exit point 102. Cooling water enters the atomizer at 104 and passes out distribution ports 106 and into the internal part of the distribution cone in order to cool the atomizer and protect it from severe high temperatures. The cooling water passes out of the atomizer through an annular pipe at 108.

Figure 4:
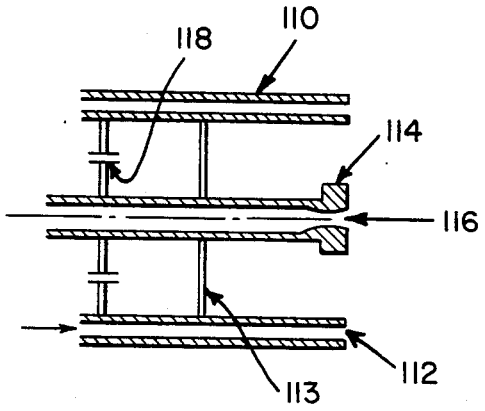
FIG. 4 is a schematic cross-sectional side view of an alternate design of a fuel dispensing nozzle such as may be used in the present invention.
Figure 5:
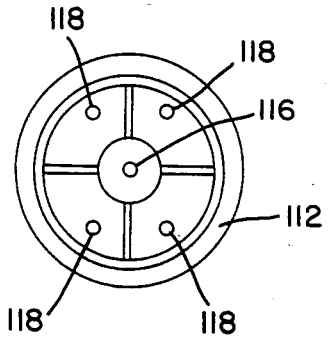
FIG. 5 is an end view of FIG. 4 sharing additional details of the fuel dispensing nozzle.

In another embodiment, the supplementary fuel and the liquid sludge are not mixed prior to introduction to the incineration zone, but are introduced by means of separate conduits in the dispensing device or through a plurality of dispensing devices. Thus, for example, as shown in FIGS. 4 and 5, the supplemental fuel and sewage sludge may be introduced by means of a pressure nozzle in which the supplemental fuel enters the incinerator through a conduit separate from that of the sewage sludge. In a pressure nozzle of this type, the supplemental fuel such as ultrafine coal, sawdust, oil, combustible gases or mixtures thereof flows, preferably with supplementary air, through annular conduit 110. The annular orifice opening shown at 112 is sized to provide atomization characteristics suitable for the fuel to be used in accordance with generally known procedures. The sewage sludge passes through conduit 114 and through atomization orifice 116. If supports 113 are not a solid plate, such as has been described with respect to FIG. 3, and if cooling water is not necessary, tubes 118 may carry secondary combustion air.

In still another embodiment, a plurality of atomization devices may be used wherein the sewage sludge is dispersed to the incineration zone by means of a spinning cone atomizer and a supplemental fuel is introduced to the incinerator by means of a pressure nozzle with the dispersion of the sewage sludge and the fuel being intimately mixed for uniform combustion. It is understood that other combinations of atomization devices could also be used in the dispersing procedure. In any case, the construction of the atomizing device may be in accordance with the design of such units generally known in the art. That is, if a spinning cone or disc atomizer is used, deflection plates may be used at the outlet of the atomizer to rotate the device in place of a motor. Also, the construction of the atomizer should take into account the content of the liquid sludge so as to specify the droplet diameter which will provide for complete combustion of the combustible material in the sludge. In this regard, the rotational speed of the atomizer must be specified in order to achieve a given drop size distribution and the height of the incinerator must be sufficient to provide the particles the required residence time in the hot gases. The drop diameter of the sludge droplet is also of concern because, together with the density of the drop and viscosity of the gas, it controls the settling velocity of the droplet. Too light a droplet will be swept out before it can undergo proper processing. Too heavy a droplet will settle too rapidly and also not be processed properly. Moreover, since the gases evolving from the combustible fuel are convecting upward with a velocity dependent upon the burning rate, the settling velocity of the droplet must be greater than the upward convective velocity so that the particle will descend slowly into the flame front.

In the first stage of the incineration of atomized sewage sludge, the diameter of the droplet will decrease as the evaporation of water occurs, which will change the settling velocity of the droplet. The second stage which the sludge droplet experiences is the precipitation of dissolved solids and the congealing of suspended solids into a solid core. The original droplet which was mostly liquid is at this point a solid wet particle. The third stage involves the drying of the particle to a hard core which shrinks even more in size, and the fourth stage involves the heating of the solid particle to the combustion temperature and the resultant degration to gaseous products and ash.

In still another embodiment, alkaline material in the form of a dust or slurry is introduced in admixture with the sludge, the supplemental fuel, or both. Alternatively, the alkaline material may be introduced to the incineration zone through a separate dispensing device to effect neutralization of the acidic gases before these gases leave the incinerator.

In a preferred embodiment, wherein steam is produced and sludge is introduced to the incineration zone in a weight of approximately 7% of the total fuel to the incinerator, ultrafine coal is mixed with the sewage sludge in an amount of about 1 quart of coal per gallon of sludge, and the remaining fuel is introduced in the form of municipal refuse at a point in the incinerator below the atomizer. As previously mentioned, this process has been developed to coincinerate municipal waste sludge having energy content of approximately 1,500 BTU per pound, with the sludge containing at least about 5% solids, and will provide an acceptable level of steam production.

Figure 6:
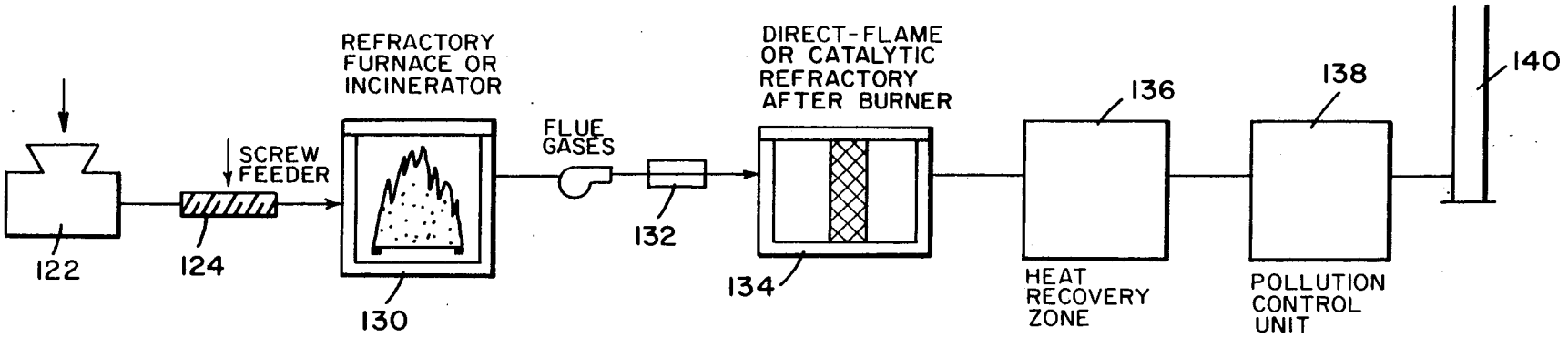
FIG. 6 is a schematic view of another embodiment of the present invention illustrating an efficient removal of dioxin material produced in an incineration zone.
Figure 7:
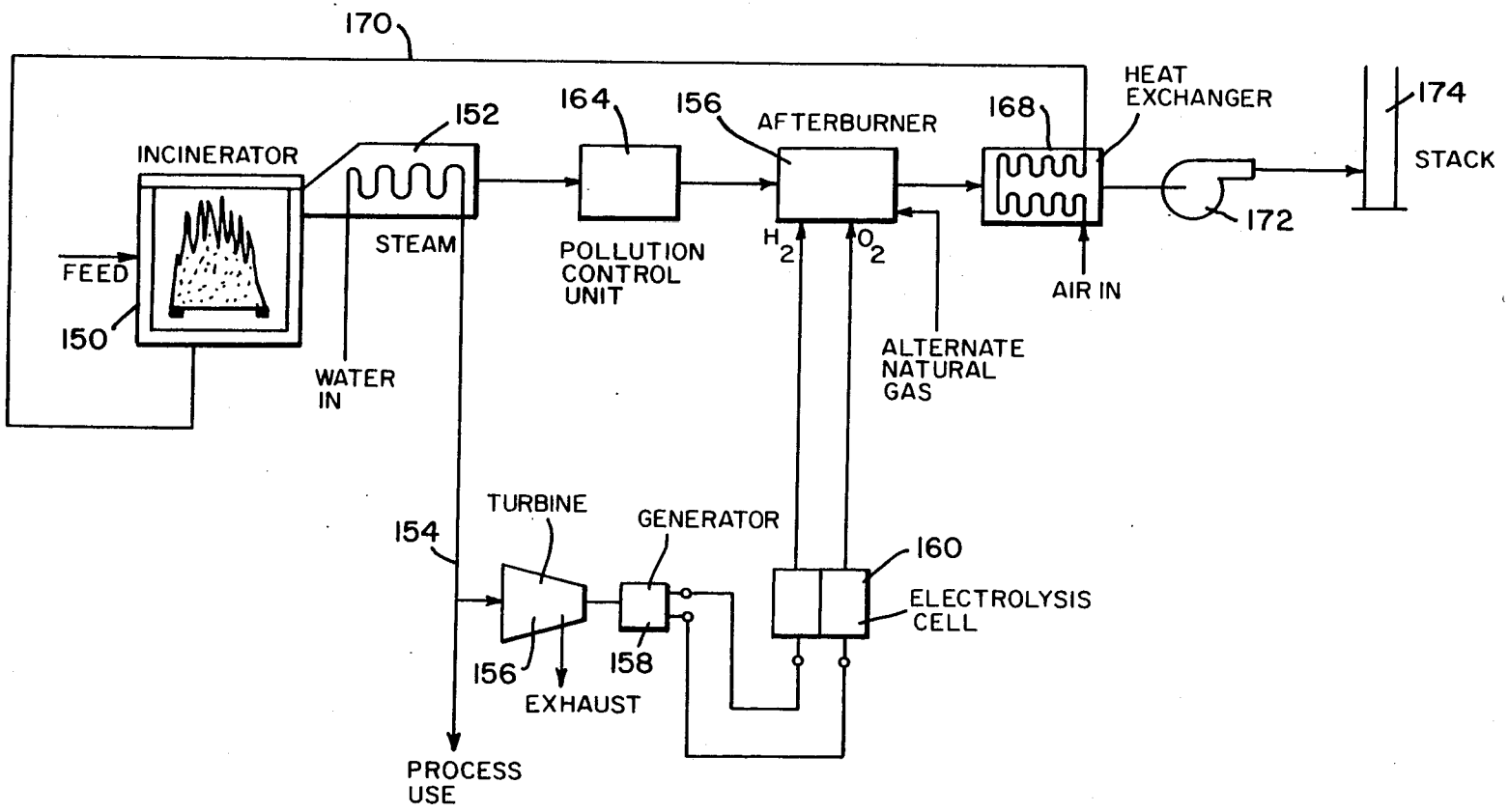
FIG. 7 is a schematic view of an embodiment of the present invention including an electrolysis apparatus by which hydrogen and oxygen are produced and directed to an afterburner for destruction of dioxin compounds produced by incineration.

As shown in FIGS. 6 and 7, the present invention also provides a method for eliminating dioxin compounds formed by the incineration of sewage sludge and other materials described above. Dioxins are polyhalogenated dibenzo-p-dioxin compounds, which have the general formula $C_{12}H_{8-y}Z_yO_2$ wherein Z represents either chlorine, iodine or bromine, and Y can range from 0 to 8. The most prevalant members of this class are the chlorinated members, such as the tetra, penta, hexa, hepta, and octochlorodibenzo-p-dioxins. One dioxin compound in particular, tetrachloro dibenzo-p-dioxin, $C_{12}H_4O_2Cl_4$, is toxic in the parts per billion range and, therefore, must be completely eliminated from incinerator stack gases.

As mentioned previously, the combustion temperature of many incinerator systems is between 1500° F. and 1800° F. This temperature range is insufficient to eliminate dioxin compounds. By the present invention, however, it has been discovered that the addition of about 15% by weight tire chips to the incineration process permits the incineration zone to operate at a temperature significantly above typical prior art incineration systems and eliminate or substantially reduce the dioxin compounds present in the incinerator off gases. With the addition of approximately 15% tire chips to the incineration zone, the incinerator may be operated at temperatures of from 2000° F. or more which substantially eliminates the dioxin compounds. The dioxins remaining in the incinerator off gas, if any, may be removed passing the gases to a thermal or a catalytic afterburner.

As shown in FIG. 6, solid municipal waste is mixed with tire chips in storage hopper 122. The tire chips are present in an amount of at least 15% by weight of the fuel to the incinerator and are preferably introduced in fragments between 1 to 4 inches in size. The feed mixture is passed by means of screw auger 124 to incinerator 130 wherein sewage sludge is preferably introduced by means of an atomizer such that shown at 30 and 78 in FIGS. 1 and 2 respectively.

The addition of at least 15 weight % tire chips increases the energy content of the incinerator and allows the incinerator to be operated at temperatures of from 2000° F. to 2300° F. or higher, which substantially reduces or eliminates dioxin compounds formed by the incineration process. The dioxin content of the gases leaving the incinerator 130 is measured, and if unacceptably high, the incinerator off gases leaving incinerator 130 are passed directly to an afterburner pre-heat zone 132 and then to a afterburner 134. The afterburner may be a thermal afterburner operating at between 2000° F. and 2300° F. or a catalytic afterburner operating at from 700° F. to 1200° F. If a catalytic afterburner is used, the catalyst should contain a noble metal material such as platinum or palladium. Also, in a catalytic afterburner system, an afterburner preheat zone may not be necessary. It has been found that if an afterburner is required, a significant energy savings results if the incinerator off gases are passed directly to the afterburner zone without cooling, as opposed to a method whereby incinerator off gases are passed to a heat recovery zone, and then the cooled gases are reheated to the afterburner temperature.

If a thermal afterburner is employed to eliminate dioxin compounds, it is recommended that the afterburner be lined with a refractory material such as silicon carbide to protect the unit from the high temperatures. In addition, since particulates are also present in the incinerator off gases, it is imperative in the design of the afterburner that "trapping" or settling of the particulates be avoided. This requires that the flow distribution within the afterburner be uniform and that cyclonic effects which would exert a centrifugal force on the particulates causing them to stratify in the gas stream be avoided. However, immediately after the dioxin materials in the gases and particulates have been destroyed, it has been found to be an advantage of the present invention to incorporate within the end sections of the afterburner a separation device such as cylone separator in order to rid the gas stream of much of the particular matter present therein. In this regard, it has been found that under steady state conditions, the residence term in the thermal or catalytic afterburner is generally from about 0.5 to 4.0 seconds.

After leaving the afterburner and particle separation zone, the still hot incineration off gases may then be passed to a heat recovery zone 136 to produce steam and a pollution control zone 138 before being dispersed to the atmosphere by means of stack 140. It should be noted that incineration of the above feed mixture generates a significant quantity of acidic gases and particulate matter. Accordingly, a pollution control unit such as that described in FIG. 1 including an alkaline contact zone and a particulate recovery zone is recommended before release of the off gases to the atmosphere.

The operation of heat recovery zone 136, pollution control 138 and stack 140 may be as described with regard to FIG. 1. Alternatively, as illustrated in FIG. 7, the off gases from incinerator 150 may be passed directly to a heat recovery zone 152 to generate steam. The steam produced by this process may then be directed through conduit 154 to drive turbine 156 and generator 158, which are operated in connection with an electrolysis cell such as at 160 to produce hydrogen and oxygen. The off gases from the heat recovery zone 152 containing particulate matter as well as acidic compounds may then be passed to a pollution control unit 164 including a particulate separator and an alkaline contactor such as that described with reference to FIG. 1 above. The cooled exhaust gases from the pollution control unit 164 may then be passed to afterburner unit 156, which is fueled at least in part with hydrogen and oxygen gas produced by electrolysis cell 160, wherein dioxin compounds present in the off gases are eliminated. The hot afterburner exit gases may then be passed to heat recovery zone 168 wherein incineration combustion gas in conduit 170 is heated by indirect heat exchange. The cooled and substantially dioxin free gases would then be directed by means of draft fan 172 to stack 174 for release to the atmosphere.

Figure 8:
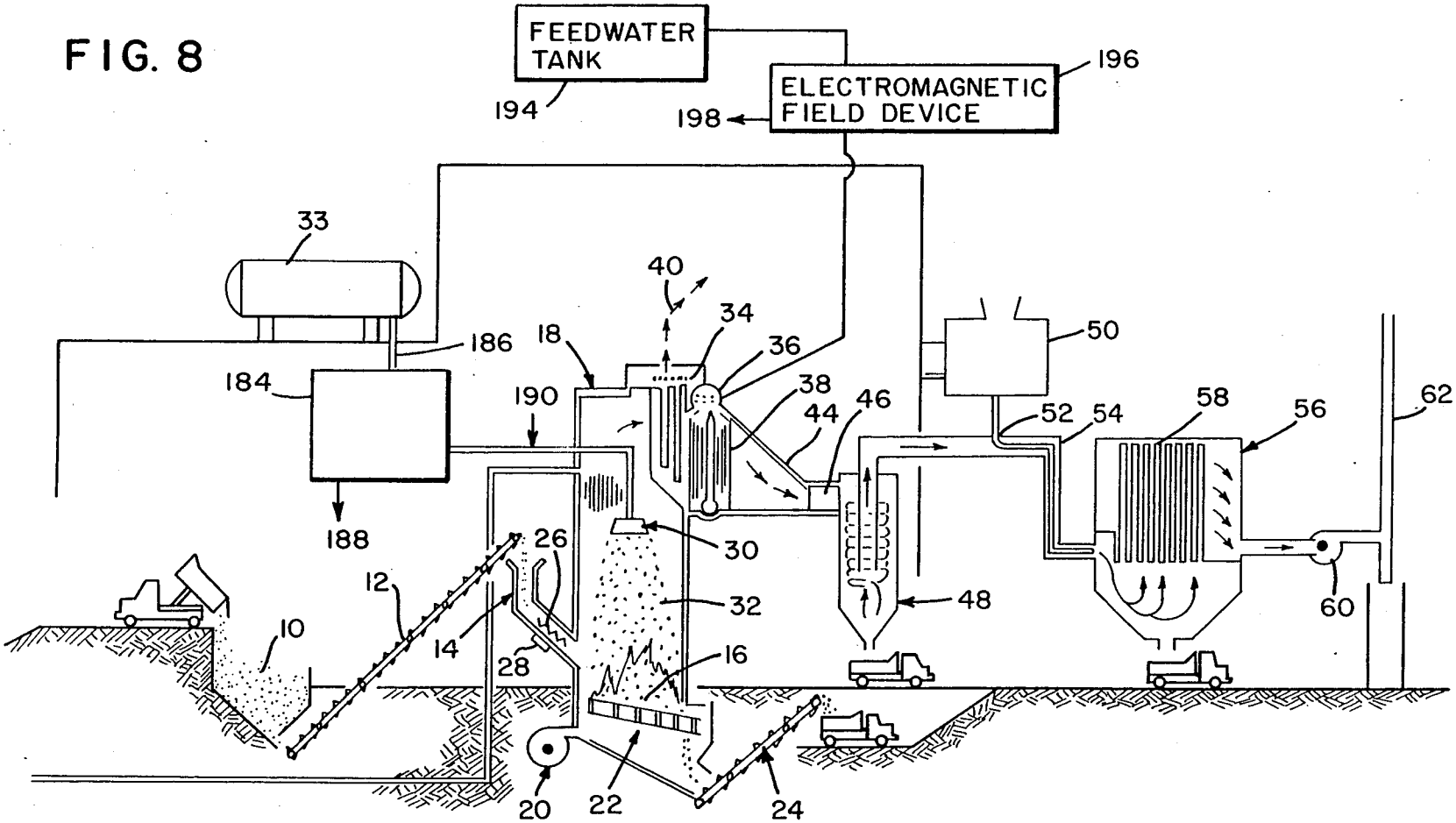
FIG. 8 is a schematic view of an embodiment of the present invention whereby sewage sludge and boiler feedwater are each contacted with an electromagnetic device to remove dissolved solids and metal salts.
Figure 9:
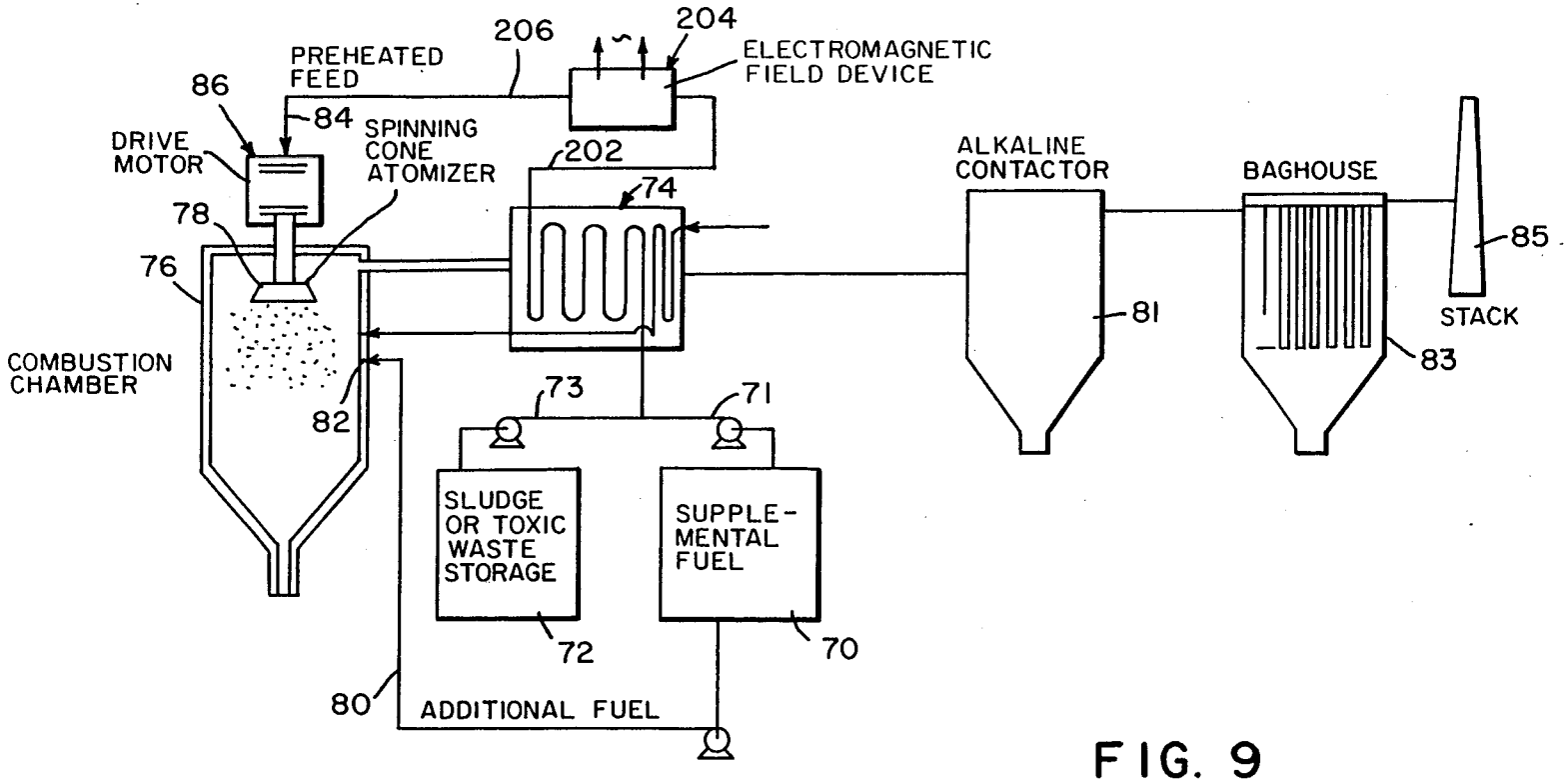
FIG. 9 is a schematic view of an embodiment of the present invention whereby sewage sludge and supplemental fuel are admixed and contacted with an electromagnetic field device prior to introduction to the incineration zone.

As shown in FIGS. 8 and 9, the present invention additionally provides a process whereby sewage sludge may be pretreated with an electromagnetic field device prior to introduction to the incinerator. Treatment with an electromagnetic field device significantly reduces the metals and other incombustible impurities in the sludge such as iron and calcium components. Removal of these incombustible materials prior to introduction of the sludge into the incinerator is a significant advantage over prior processes because these materials tend to accumulate in the lower section of the incinerator such as on the incinerator walls and grate. Accumulation of these materials blocks the flow of combustion air to the incinerator and requires periodic cleaning of the unit, and the present invention substantially reduces this problem by prior removal of these noncombustibles.

As shown in FIG. 8, the electromagnetic field device 184 may be used to treat sludge stream 184 prior to atomization. In this embodiment, sludge from storage tank 33 is introduced through conduit 186 to electromagnetic device 184. In the electromagnetic field device, a field strength of at least 1,000 oersteds is applied to the sludge feed to effect a physiochemical change in the sludge, and metal impurities are separated from the combustible sludge material and removed with waste water through conduit 188. By this treatment, the sludge is concentrated, the consistency of the sludge is improved and the pumpability of the sludge is increased.

The coincineration process shown in FIG. 8 is operated in accordance with the description of FIG. 1. That is, sludge from electromagnetic device 184 is directed to atomizer 30 and incineration zone 18, through flow conduit 190. It should be noted that treatment with the electromagnetic field device in this manner not only increases the density and consistency of the sludge, but also provides a sludge which is more readily atomized and combusted once in the incineration zone.

As also seen in FIG. 8, the use of an electromagnetic field device is not limited to treatment of the sewage sludge but may also be used to treat the feedwater to the boiler tubes in instances where steam generation is desired. By this process, water from feedwater tank 194 is directed to electromagnetic field device 196, and an electromagnetic field having a strength of at least 1,000 oersteds is applied. As a result, dissolved solids and metal salts in the feedwater are substantially removed through conduit 198, and a relatively pure feedwater is directed to the boiler through conduit 200. Pretreating the boiler feedwater in this manner substantially reduces the instances of scaling and fouling of boiler tubes thus increasing the durability and efficiency of the overall incineration process.

The process illustrated in FIG. 9 is operated in accordance with the process described with reference to FIG. 2, and additionally, shows the use of an electromagnetic field device to treat a sewage sludge feed prior to incineration in combination with a supplemental fuel mixture. Accordingly, the sludge and supplemental fuel mixture which exits incineration preheat zone 74 in conduit 202 may be passed to electromagnetic field device 204 for further treatment. In addition to the advantages described, which include further concentrating the sewage sludge, increasing consistency, providing relatively easy pumpability and atomization and removing incombustible materials from the incineration zone, pretreatment of the sludge and supplemental fuel mixture in this manner provides for effective dispersion of the sludge within the supplemental fuel to ensure uniform atomization characteristics.

Electromagnetic field devices which may be employed on the feedwater and sludge or sludge/supplemental fuel stream are of the type generally known in the art. Such devices may be obtained, for example, from Electronic Water Conditioners, Inc. under the trademark Electro-Mag.

Having described in detail a preferred embodiment of the invention and before continuing with the claim portion of the specification, it may be useful to briefly set forth some of the major advantages of the invention.

SUMMARY OF MAJOR ADVANTAGES OF THE INVENTION

In describing a coincineration process in accordance with preferred embodiments of the invention, those skilled in the art will recognize several advantages which singularly distinguish the subject invention from the heretofore known prior art. A particular advantage of the subject invention is the separate introduction of the sewage sludge to the incineration zone in atomized form. By this process, exact control can be maintained over the amount of liquid waste and the amount of supplemental fuel introduced to the incineration zone so that each may be adjusted in accordance with the moisture content thereof. Also, the introduction of the sludge in atomized form above the flame front in the incineration zone provides for a large contact area for the dispersed sludge material and the incineration combustion gases, thus providing for relatively complete combustion of the sludge.

Another significant advantage of the subject invention is the provision of an integral coincineration process whereby the heat generated from the combustion operation is recovered to produce steam and whereby the acidic gases and particulates produces from this process are effectively eliminated prior to release of the off gas to the atmosphere.

Still a further advantage associated with the present invention is the operation of the incineration zone at a temperature of at least 2000° F. to reduce or eliminate dioxin compounds formed by the incineration of waste materials. Unlike prior coincineration systems, the present invention may attain such temperatures by the inclusion of at least 15 weight % of tire chips.

Still a further advantage of the present invention is inclusion of an electromagnetic field device on the sludge feed line prior to introduction of the sludge to the incineration zone. The electromagnetic field device effectively removes noncombustible materials such as metal salts from the sludge, which reduces fouling of the incinerator as well as increasing the concentration, consistency, pumpability, and atomization characteristics of the sludge.

In describing the invention, reference has been made to preferred embodiments. Those skilled in the art, however, and familiar with the disclosure of the subject invention, may recognize additions, deletions, substitutions, modifications and/or other changes which will fall within the purview of the invention as defined in the following claims.

What is claimed is:

1. A process for coincinerating sewage sludge or toxic liquid chemical waste and a supplemental fuel comprising the steps of:
   - introducing non-gaseous supplemental fuel into an incineration zone at a point intermediate a vertical length of said incineration zone to produce a flame front intermediate the vertical length of said incineration zone;
   - incinerating said introduced non-gaseous supplemental fuel to achieve a combustion temperature approximately between 1800 to 2300 Fahrenheit;
   - dispersing said sewage sludge or toxic liquid chemical waste in relatively small droplets downwardly over said flame front in said incineration zone to evaporate water in said droplets and to destroy toxicity of toxic waste by combustion in said incineration zone;
   - recovering hot incineration off gases from said incineration zone, wherein the mixture of said sewage sludge or toxic liquid chemical waste and said supplemental fuel comprises about 84% trash, 15% tire chips and 1% sewage sludge or liquid chemical waste.

2. A coincineration process as defined in claim 1 wherein:
   - the overall moisture content of the feed to the incinerator is less than 27% by weight.

3. A coincineration process as defined in claim 1 wherein:
   - said supplemental fuel includes municipal waste and wherein said waste is introduced into said incineration zone by means of a water-cooled hopper to prevent premelting of the waste material in the hopper.

4. A coincineration process as defined in claim 1 wherein:
   - said incineration zone comprises a double-walled construction and is water-cooled by passing water between the walls of such double-walled construction.

5. A coincineration process as defined in claim 1 wherein:
   - said incineration zone contains at least one moveable grate at the bottom thereof and said process further comprising blowing air, oxygen or mixtures thereof in the bottom of said furnace and onto the bottom of said grate to insure complete combustion.

6. A coincineration process as defined in claim 1 wherein: combustion air is introduced to the incineration zone in an amount 50% to 150% in excess of the stoichiometric amount.

7. A process for coincinerating semi-solid waste sludge, and a supplemental fuel for detoxicating toxicity in said sludge and evaporating water in said sludge comprising the steps of:
   - spraying said semi-solid waste sludge in combination with said supplemental fuel in droplets into an upper end of an incineration zone having an upper end and a lower end;
   - incinerating said sprayed combination in said incineration zone to produce a flame front intermediate the vertical length of said incinerator zone in a temperature range of between approximately 1800° F. and 2300° F. for destroying toxicity in said semi-solid waste sludge and for evaporating water content of said droplets; and recovering hot incineration off gases from said incineration zone.

8. A coincineration process as defined in claim 7 wherein:

said semi-solid sludge in combination with said supplemental fuel are sprayed into said incineration zone by means of a spinning cone or disc atomizer.

9. A coincineration process as defined in claim 7 wherein:

said semi-solid sludge in combination with said supplemental fuel are sprayed into said incineration zone by means of a pressure spray nozzle.

10. A coincineration process as defined in the steps of claim 7 wherein:

said supplemental fuel sprayed into said incineration zone comprises ultrafine coal, sawdust, oil or gas.

11. A coincineration process as defined in claim 7 wherein:

said semi-solid sludge and said supplemental fuel apart from said waste are sprayed into said incineration zone through separate flow conduits in a spraying means.

12. A coincineration process as defined in claim 11 wherein:

said semi-solid waste sludge and said supplemental fuel apart from said waste are sprayed into said incineration zone through separate flow conduits in a spraying means; and alkaline material is sprayed into said incineration zone with said semi-solid sludge and said supplemental fuel to neutralize acidic gases produced by incineration.

13. A coincineration process as defined in claim 7 wherein:

a solid combustible fuel is additionally introduced to said incineration zone at an intermediate point along the vertical length of said incineration zone and below the point at which combustible fuel is sprayed into said zone.

14. A coincineration process as defined in claim 13 wherein:

said solid combustible fuel which is introduced at said intermediate point in said incineration zone comprises up to 15% tire chips by weight.

15. A coincineration process as defined in claim 7 wherein:

sewage sludge or toxic liquid chemical waste is introduced to said incineration zone in an amount between 5 and 50 weight percent of the combustible fuel to the incineration zone.

16. A coincineration process as defined in claim 15 wherein:

the amount of sewage sludge or toxic liquid chemical waste is 15% by weight of said combustible fuel introduced.

17. A coincineration process as defined in claim 13 wherein:

sewage sludge comprises up to 90% of the combustible fuel introduced to the incinerator zone by spraying.

18. A coincineration process as defined in claim 7 wherein:

said incineration zone off gases comprise dioxin compounds.

19. A coincineration process as defined in claim 18 wherein:

said incineration zone off gases are passed directly from said incineration zone to an afterburner zone wherein said dioxin compounds in said gases are thermally or catalytically decomposed.

20. A coincineration process as defined in claim 18 and further comprising:

passing the off gases from said afterburner zone to an indirect heat recovery zone to produce steam.

21. A coincineration process as defined in claim 18 and further comprising:

passing the off gases from said afterburner zone directly to an afterburner preheat zone to preheat said incineration zone off gases.

22. A process for incinerating a combustible fuel as defined in claim 18 and further comprising:

passing the off gases from said afterburner zone directly to an incineration preheat zone to preheat fuel to said incineration zone.

23. A coincineration process as defined in claim 7 and further comprising:

contacting sewage sludge or toxic liquid chemical waste with an electromagnetic field device prior to passing said sludge or liquid waste to said incineration zone.

24. A coincineration process as defined in claim 23 wherein:

the field strength applied to said sewage sludge or toxic liquid chemical waste is 1000 orsteads.

25. A coincineration process as defined in claim 7 wherein:

feedwater is passed to a heat recovery zone for indirect heat exchange with said hot off gases, and said feedwater is contacted with an electromagnetic field device prior to heating.

26. A coincineration process as defined in claim 25 wherein:

the field strength applied to said sewage sludge or toxic liquid chemical waste is 1000 oersteds.

27. A coincineration process as defined in claim 24 wherein:

said semi-solid sludge is passed through said electromagnetic field device in admixture with supplemental fuel.

28. A coincineration process for incinerating sewage sludge or toxic liquid chemical waste in combination with a supplemental fuel while minimizing dioxin content of incineration off gases comprising:

introducing a combustible fuel into an incineration zone, said combustible fuel comprising at least 15% tire chips by weight;

incinerating said introduced combustible fuel in said incineration zone to achieve a combustion temperature range of between approximately 1800° F. and 2300° F.;

coincinerating said sewage sludge or toxic liquid chemical waste in said combustion zone along with said combustible fuel, in combustion temperature of between approximately 1800° F. and 2300° F. to destroy toxicity in toxic waste and to evaporate water content of sludge;

whereby dioxin content of incineration off gas is effectively reduced in said combustion zone; and recovering said incineration off gases having said reduced dioxin content from said incineration zone.

29. A coincineration process for incinerating sewage sludge or toxic liquid chemical waste in combination with a supplemental fuel while minimizing dioxin content of incineration off gases comprising:

introducing a fraction of solid combustible fuel including tire chips at least 15% by weight of said combustible fuel into an incineration zone having an upper section and a lower section;

incinerating said introduced fuel to produce a flame front intermediate vertical length of said incineration zone, said flame having a temperature at least in a range of between approximately 1800° F. and 2300° F.;

dispersing sewage sludge or toxic liquid chemical waste in relatively small droplets over the flame front in said incinerating zone to coincinerate said combustible material in said droplets for evaporating water content and destroying toxicity in said droplets, whereby dioxin content of incineration off gases is effectively reduced; and recovering said incineration off gases having said reduced dioxin content from said incineration zone.

30. A coincineration process as defined in claim 28 or 29 and additionally comprising the steps of:

passing said incineration zone off gases directly to a thermal afterburner preheat zone;

passing the exit gases from said afterburner preheat zone to a thermal afterburner zone to thermally decompose said dioxin compounds;

passing afterburner off gases to an indirect heat exchange zone wherein the temperature of said gases is lowered; and passing the relatively cool off gases to a pollution control zone.

31. A coincineration process as defined in claim 28 or 29 comprising the steps of:

passing said incineration zone off gases directly to a catalytic afterburner zone;

passing the afterburner off gases to an indirect heat exchange zone wherein the temperature of said gases is lowered; and passing the relatively cool off gases to a pollution control zone.

32. A coincineration process as defined in claim 28 or 29 wherein:

said incinerator zone is operated at a temperature of from 2000°–2300° F.

33. A coincineration process as defined in claim 27 wherein: said thermal afterburner zone is operated at a temperature from 2000° F. to 2500° F.

34. A coincineration process as defined in claim 28 wherein:

said catalytic afterburner is operated at a temperature of from 700° F. to 1200° F.

35. A process for removing dioxin compounds from incineration off gases as defined in claim 28 wherein:

said catalytic afterburner zone comprises a noble metal catalyst.

36. A process for removing dioxin compounds from incineration off gases as defined in claims 27 or 28 wherein:

said pollution control zone comprises an alkaline contact zone followed by a particulate collection zone.

37. A coincineration process as defined in claim 28 or 29 wherein toxic liquid chemical waste is coincinerated with said supplemental fuel.

38. A coincineration process as defined in claim 28 or 29 wherein both semi-solid sludge waste and toxic liquid chemical waste are coincinerated with said supplemental fuel.

39. A coincineration process as defined in claim 37 wherein combustion of said toxic liquid waste in said incineration zone effectively eliminates toxicity of said toxic liquid chemical waste.

40. A process for coincinerating semi-solid sludge waste or toxic liquid chemical waste, and a supplemental fuel for detoxicating said liquid waste and evaporating water in said sludge comprising the steps of:

spraying said sludge or toxic liquid chemical waste in combination with said supplemental fuel in droplets into an upper end of an incineration zone having an upper end and a lower end, whereby toxic liquid chemical waste is coincinerated with said supplemental fuel;

incinerating said sprayed combination in said incineration zone to produce a flame front intermediate the vertical length of said incinerator zone in a temperature range of between approximately 1800° F. and 2300° F. for destroying any toxicity of said liquid waste and for evaporating water content of said droplets; and recovering hot incineration gases from said incineration zone.

41. A process for coincinerating sewage sludge or toxic liquid chemical waste, and a supplemental fuel for detoxicating said liquid waste and evaporating water in said sludge comprising the steps of:

spraying said sewage sludge or toxic liquid chemical waste in combination with said supplemental fuel in droplets into an upper end of an incineration zone having an upper end and a lower end;

incinerating said sprayed combination in said incineration zone to produce a flame front intermediate the vertical length of said incinerator zone and having a temperature range of between approximately 1800° F. and 2300° F. for destroying toxicity of said liquid waste and for evaporating water content of said droplets; and recovering hot incineration gases from said incineration zone, wherein a fraction of said sewage sludge or toxic liquid chemical waste is admixed with said supplemental fuel prior to spraying into said incinerator.

42. A process for coincinerating sewage sludge or toxic liquid chemical waste and a supplemental fuel comprising tire chips in an amount of at least 15% by weight having the steps of:

introducing non-gaseous supplemental fuel into an incineration zone at a point intermediate a vertical length of said incineration zone to produce a frame front intermediate the verticle length of said incineration zone;

incinerating said introduced non-gaseous supplemental fuel to achieve a combustion temperature of at least approximately 2,000 degrees Fahrenheit;

dispersing said sewage sludge or toxic liquid chemical waste in relatively small droplets downwardly over said flame front in said incineration zone by means of a pressure atomizing nozzle to evaporate water in said droplets and to destroy toxicity of toxic waste by combustion in said incineration zone;

recovering hot incineration off-gases from said incineration zone; and passing said off gases to an alkaline contact zone to neutralize acidic components in said gases.

43. A process for coincinerating sewage sludge or toxic liquid chemical waste and a supplemental fuel comprising tire chips in an amount of at least 15% by weight having the steps of:

introducing non-gaseous supplemental fuel into a single incineration zone at a point intermediate a vertical length of said incineration zone to produce a frame front intermediate the verticle length of said incineration zone;

incinerating said introduced non-gaseous supplemental fuel to achieve a combustion temperature of at least approximately 2,000 degrees Fahrenheit;

dispersing said sewage sludge or toxic liquid chemical waste in relatively small droplets downwardly over said flame front in said incineration zone by means of a spinning cone or disk atomizing to evaporate water in said droplets and to destroy toxicity of toxic waste by combustion in said incineration zone;

recovering hot incineration off-gases from said incineration zone; and passing said off gases to an alkaline contact zone to neutralize acidic components in said gases.

* * * * *